US005588764A

United States Patent [19]

Kato

[11] Patent Number: 5,588,764

[45] Date of Patent: Dec. 31, 1996

[54] LOCK FOR DEFLECTABLE WRITING UTENSIL

[75] Inventor: Hiroyasu Kato, Takizaki, Japan

[73] Assignee: Katoh Kinzoku Kogyo Kabushiki Kaisha, Tomioka, Japan

[21] Appl. No.: 498,124

[22] Filed: Jul. 5, 1995

[30] Foreign Application Priority Data

Jan. 26, 1995 [JP] Japan ..... 7-030135

[51] Int. Cl.[6] ..... B43K 7/12; B43K 24/00

[52] U.S. Cl. ..... 401/99; 401/109; 401/117

[58] Field of Search ..... 401/99, 61, 109, 401/110, 111, 112, 113, 117

[56] References Cited

U.S. PATENT DOCUMENTS

| | | | |
|---|---|---|---|
| 2,395,709 | 2/1946 | Anderson | 401/61 |
| 2,988,054 | 6/1961 | Yates | 401/112 |
| 4,580,919 | 4/1986 | Ambasz | 401/117 |
| 4,606,665 | 8/1986 | Schleif et al. | 401/117 X |

FOREIGN PATENT DOCUMENTS

| | | | |
|---|---|---|---|
| 1020256 | 11/1957 | Germany | 401/99 |
| 1294262 | 4/1969 | Germany | 401/109 |

*Primary Examiner*—Steven A. Bratlie

*Attorney, Agent, or Firm*—Armstrong, Westerman, Hattori, McLeland & Naughton

[57] ABSTRACT

In a lock for a deflectable writing utensil 4 in which a forward external casing 1 and a rearward external casing 2 are deflectably connected to push in and out a writing tip 3 from a position in the forward external casing 1 by a deflecting mechanism, a lock casing 6 is slidably fitted along a periphery of the rearward external casing 2 through a hooking pin 5, 5, a forward end of the lock casing 6 being hooked by the hooking pin 5, 5 and also being capable of being put forward to the forward external casing 1 to extend across and cover the deflecting mechanism.

1 Claim, 2 Drawing Sheets

LOCK FOR DEFLECTABLE WRITING UTENSIL

BACKGROUND OF THE INVENTION

1. Field of the Invention

This invention relates to an improved deflectable writing utensil.

2. Prior Art

In a conventional deflectable writing utensil, a forward external casing and a rearward external casing are deflectably connected for relative axial movement to push a writing tip, i.e., a lead of a mechanical pencil or a ball bearing of a ballpoint pen, in or out from a position in the forward external casing by a deflecting operation.

Such a conventional deflectable writing utensil often tends to be deflected by, for example, an incidental shock under a condition of non-use to possibly push out the writing tip and stain clothes. Further, because of substantially identical length thereof when under conditions of use or non-use, sometimes it is difficult to keep the writing utensil stably in a shallower pocket, such as that of shirts.

SUMMARY OF THE INVENTION

An object of the present invention is to provide a lock for a deflectable writing utensil in which a forward external casing and a rearward external casing are deflectably connected to push in and out a writing tip from a position in the forward external casing by a deflecting operation, characterized in that a lock casing is slidably fitted along a periphery of the rearward external casing through a hooking pin, a forward end of the lock casing being hooked by the hooking pin and also capable of being moved forward to the forward external casing.

DETAILED DESCRIPTION AND THE PREFERRED EMBODIMENTS

Figure 1:
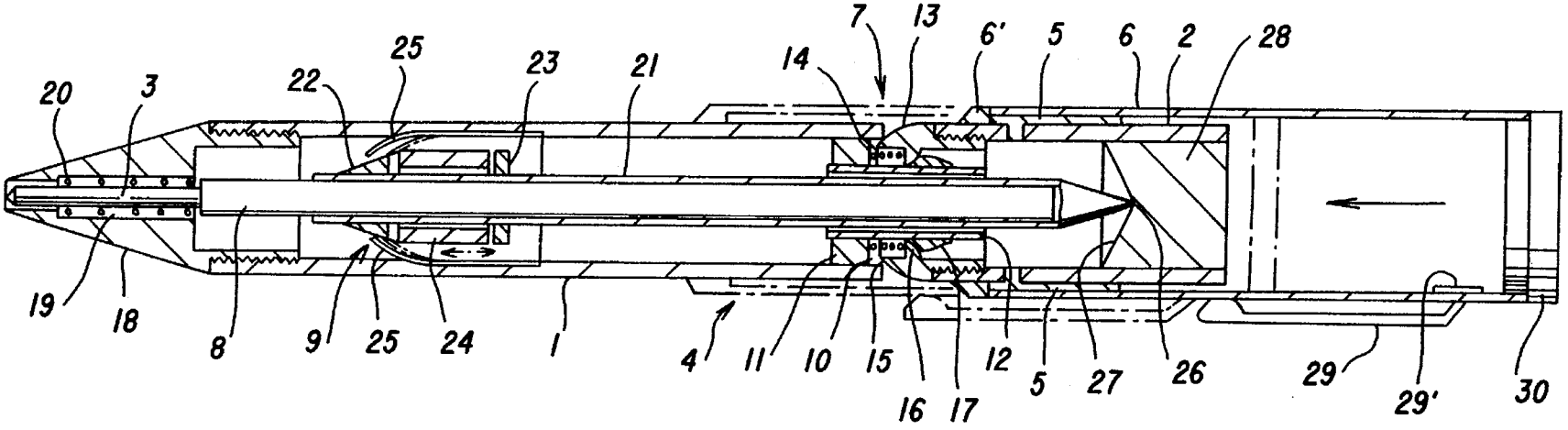
FIG. 1 is a cross-sectional view of a locked ballpoint pen according to the present invention.

FIG. 1 shows an embodiment of the present deflectable writing utensil 4 embodied in a ballpoint pen. The utensil 4 comprises a deflecting mechanism 7 for allowing a forward external casing 1 and a rearward external casing 2 to deflect with respect to each other and a stopping mechanism 9 of a ball bearing 3 (or writing tip 3) of a ballpoint pen refill 8, the refill 8 being pushed in and out by a deflecting operation. The deflecting mechanism 7 comprises a main axial pipe 12 projected backward through a fixed body 11, which forms a fixing portion 10 at a rearward position of the forward external casing 1, and a deflecting slide 13 screwed at a tip of the rearward external casing 2. The main axial pipe 12 is inserted through a strong spring 14 into the deflecting slide 13. The deflecting slide 13 comprises a sliding head 15 which is roundly tapered at an apex thereof. The sliding head 15 is fixed to the fixing portion 10. A collar 16 formed on an inner surface of the deflecting slide 13 is pressingly engaged between the spring 14 and a front surface of a deflecting fixture 17 fixed on the main axial pipe 12.

The stopping mechanism 9 of the ballpoint pen refill 8 comprises a spring 20 arranged in an inner space 19 of a head portion 18 to push the refill 8 backward through an inserting tube 21 in which the refill 8 is inserted and that projects backward through the main axial pipe 12. An expansion cam 22 is fixed on a from portion of the inserting tube 21 and expanded outwardly in a backward direction. An idler ring 24 fits loosely around the inserting tube 21 between the expansion cam 22 and a stopper 23 fixed on the inserting pipe 21 to permit a certain play. More than three circumferentially spaced elastic lock links 25 and 25 are positioned in the forward casing 1 and a supporting body 28 provided with a cone surface 27 for receiving a conical sliding head 26 carried by the back end of the inserting tube 21 is positioned in the rearward external casing. The supporting body 28 is fixed to an inner surface of the rearward external casing 2. In FIG. 1, numerals 29 and 30 indicate a clip and a top cap, respectively.

Figure 2:
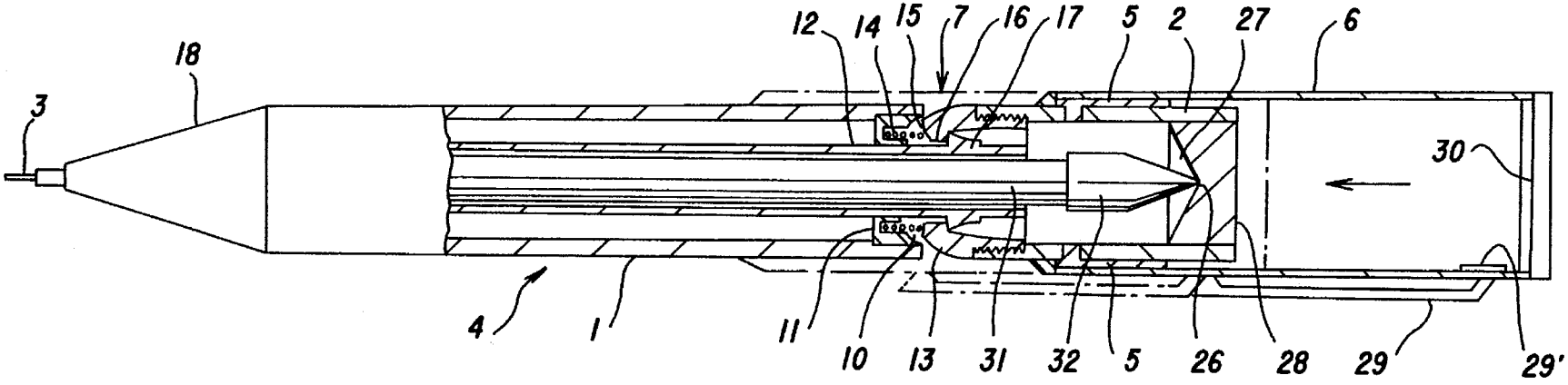
FIG. 2 is a cross-sectional view of a locked mechanical pencil according to the present invention.

FIG. 2 shows an embodiment of a mechanical pencil of a lead-push-out type according to the present invention. Similarly as the ballpoint pen shown in FIG. 1, a deflecting mechanism 7 allows a forward external casing 1 and a backward external casing 2 to deflect with respect to each other. While in the present mechanical pencil, a lead tube 31 corresponding to the sliding tube 21 of the ballpoint pen refill is inserted through a main axial pipe 12 and capped with a cap 32 at a top end thereof. A sliding head 26 of the cap 32 is caught by a cone surface 27. The cap 32, as well as the lead tube 31, are pushed back and forth by an inner conical surface 27 in response to a deflecting operation of the deflecting mechanism 7, thereby a lead 3 or a writing tip 3 is extended out of a head portion 18. The lead 3 is put back within the casing 1 by pushing it in the head portion 18 under a condition where the forward and the rearward external casings 1 and 2 are deflected.

A back end of the rearward external casing 2 or the supporting body 28 and the top cap 30 of the lock casing 6 may be caused to adhere to each other by a magnet or other latching means (now shown) so as to prevent unintended sliding of the lock casing 6. In FIGS. 1 and 2, a fixing means 29' of the clip 29 is contacted with the back end of the rearward external casing 2 to control such sliding thereof.

The present invention can be embodied as described above. While the present writing utensil is in use, the lock casing 6 is slid to a position illustrated by solid lines in FIGS. 1 and 2 so as to keep the hook 6' away from the deflecting mechanism 7 exposing the deflecting mechanism whereby the rearward casing 2 can be angularly deflected to push out the writing tip 3 by the camming action between the cone surface 27 of body 28 and the sliding head 26 of the inserting tube.

On the other hand, while the present writing utensil is not in use casing 6, the lock is slid forwardly to extend onto the forward external casing 1 so as to cover the deflecting mechanism 7 with the lock casing 6, as shown by the broken lines in the drawing figures whereby the rearward casing 2 cannot be deflected.

As described above, in the present lock for the deflectable writing utensil 4 in which the forward external casing 1 and the rearward external casing 2 are deflectably connected to push in and out the writing tip 3 from a position in the forward external casing 1 by a deflecting operation, the lock casing 6 is slidably fitted along a periphery of the rearward external casing 2 through the hooking pin 5, 5, the forward end of the lock casing 6 being engaged by the hooking pin 5, 5. The lock casing 6 may also be put forward to the forward external casing 1 to cover the deflecting mechanism. Accordingly, the present writing utensil is not deflected by an incidental shock, etc., when in a condition of non-use so that a writing tip will not be pushed out of an end of the utensil and therefore will never stain clothes. Further, the length of the present writing utensil is shortened during a condition of non-use to keep it stably in a shallower pocket of shirts.

What is claimed is:

1. A writing utensil comprising:

a forward external casing, a rearward external casing, a deflecting mechanism interposed between said forward external casing and said rearward external casing effective, when exposed, to permit angular deflection between said rearward external casing and said forward external casing, an inserting tube carrying a writing implement slidably disposed within said forward casing and having a backward end containing a sliding head extending into said rearward external casing, a supporting body having a cam surface thereon carried by said rearward external casing operative to extend said writing implement forwardly when said rearward external casing is angularly deflected with respect to said forward external casing, and a lock casing slidably mounted on said rearward external casing and being operative, when in an extended position, to cover said deflecting mechanism and prevent deflection between said rearward external casing and said forward external casing and, when in a retracted position, to expose said deflecting mechanism whereby angular deflection between said casings is permitted to effect extension and retraction of said writing implement thereby.

* * * * *